US005487292A

United States Patent [19]

Fox

[11] Patent Number: 5,487,292

[45] Date of Patent: Jan. 30, 1996

[54] METHOD AND APPARATUS FOR ADVANCING TUBING INTO A DRAW DIE

[76] Inventor: Francis J. Fox, 2145 Corporation Blvd., Naples, Fla. 33942

[21] Appl. No.: 262,689

[22] Filed: Jun. 20, 1994

Related U.S. Application Data

[63] Continuation-in-part of Ser. No. 815,031, Dec. 31, 1991, Pat. No. 5,327,756.

[51] Int. Cl.[6] ..... B21C 9/00

[52] U.S. Cl. ..... 72/43; 72/274; 72/284; 72/283

[58] Field of Search ..... 72/43–45, 282–284, 72/60, 274

[56] References Cited

U.S. PATENT DOCUMENTS

| | | | |
|---|---|---|---|
| 2,152,842 | 4/1939 | Evans | 72/282 |
| 3,292,407 | 12/1966 | Poncar | 72/282 |
| 3,602,024 | 8/1971 | Sabroff | 72/282 |
| 3,740,985 | 6/1973 | Fuchs | 72/284 |
| 4,224,818 | 9/1980 | Jones | 72/284 |

FOREIGN PATENT DOCUMENTS

| | | | |
|---|---|---|---|
| 3811218 | 11/1988 | Germany | 72/43 |
| 426727 | 5/1974 | U.S.S.R. | 72/43 |
| 471140 | 5/1975 | U.S.S.R. | 72/282 |
| 495115 | 12/1975 | U.S.S.R. | 72/283 |

*Primary Examiner*—Daniel C. Crane
*Attorney, Agent, or Firm*—William F. Hamrock

[57] ABSTRACT

The invention is directed to a method and apparatus for advancing tubing into a draw die in reducing the diameter of the tubing. The tubing is advanced forward through opposed rotating tolls which apply compressive stress to the tubing and through a close fitting bushing. High pressure lubricant is pumped through a die socket which creates radial compressive stress on the tubing passing through the die socket into the draw die.

15 Claims, 3 Drawing Sheets

METHOD AND APPARATUS FOR ADVANCING TUBING INTO A DRAW DIE

This application is a continuation-in-part of Ser. No. 07/815,031, filed Dec. 31, 1991, now U.S. Pat. No. 5,327, 756.

FIELD OF THE INVENTION

This invention generally relates to a method and apparatus for advancing tubing into a draw die in tube drawing operations and, more particularly, to a compression feeding mechanism for advancing the tubing in the forward direction and a high pressure lubricant system for creating radial compression on the tubing in entering the draw die.

DESCRIPTION OF THE PRIOR ART

Applicant's prior application Ser. No. 07/815,031 is directed to an improved method and apparatus for forming thin spiral grooves in the inner surface of metal tubing, particularly copper tubing. This is achieved by subjecting the interior surface of the tubing to a spinner with groove forming teeth by drawing the tubing between a die and the spinner to form a plurality of internal spiral grooves within the tubing while the tubing is being reduced in diameter. There are other known commercial tube drawing machines and processes of producing inner grooved metal tubing during the processing of the tubing after it has been reduced in diameter. It is also known to draw metal tubing under inclusion of a floating mandrel or plug, without grooves, and under the utilization of a die which reduces the diameter of the tubing without internal grooves.

The problem with drawing metal tubing in a draw die while the tubing is being reduced in diameter, whether or not internal grooves are formed in the tubing, is that a drawing force must be applied to advance the tubing during the operation. There are several methods of applying the drawing force but most of the procedures are time consuming and cumbersome and create additional problems.

In applicant's prior application Ser. No. 07/815,031, there is disclosed an apparatus and method for advancing tubing forward into a draw die using a compression feeding apparatus providing a pair of rotating rolls for applying compressive force to tubing therebetween thereby advancing the tubing into the draw die. The rotating rolls have elastomeric grooved wheels which are driven by hydraulic motors. During compressive movement of the tubing between the rolls and through the draw die, the grooved tubing is pulled forward by a draw block subjecting the tubing to tensile stress which is lessened and semi-equalized by the compressive forward force exerted on the tubing by the rolls. This lessoning of tension allows the wall thickness of the tubing to remain high and to produce deeper grooves.

SUMMARY OF THE INVENTION

The present invention provides improvements in the method and apparatus for advancing tubing forward into a draw die using a spinner, or mandrel or plug (hereafter referred to as plug) in reducing the diameter of the tubing with or without forming internal grooves in the tubing.

The foregoing improvements are achieved by providing a method and apparatus which involves advancing the tubing forward through opposed rotating rolls which apply compressive stress to the tubing. The tubing is pushed through a close fitting bushing allowing zero clearance between the outside diameter of the tubing and the inside diameter of the bushing. High pressure lubricant is pumped through a die socket which creates radial compression stress on the tubing passing through the die socket into the draw die.

BRIEF DESCRIPTION OF THE DRAWINGS

A better understanding of the present invention will be had upon reference to the following detailed description when read in conjunction with the accompanying drawings.

FIG. 1 A is a schematic illustration showing the effects of stress on tubing wall.

DETAILED DESCRIPTION OF THE PREFERRED EMBODIMENT

Figure 1:
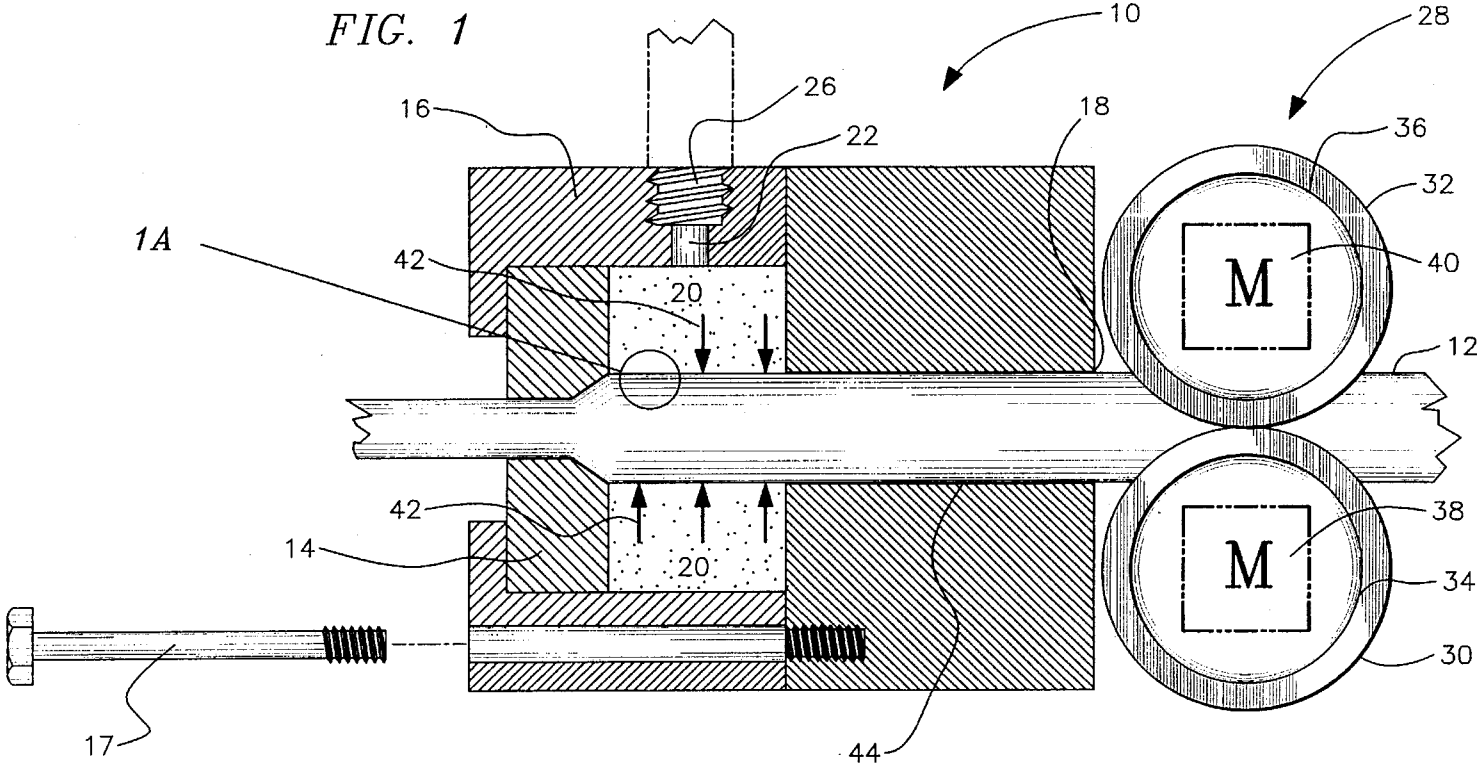
FIG. 1 is a perspective view partly in section of the apparatus which is used to practice the invention.

FIG. 1 illustrates apparatus 10 in accordance with the present invention for advancing and reducing the diameter of metal tubing 12. Apparatus 10 includes draw die 14 enclosed within die housing frame 16. The frame is attached to a circular bushing 18 by a number of screws 17 preferably about five screws. The circular bushing has a central opening for conveying the tubing horizontally to the die. The circular bushing opening extends to cylindrial die socket 20 approach zone to the draw die and thus encircles the front entrance of the draw die. Lubricant supply port 22 delivers high pressure lubricant from a lubricant source into die socket 20 into contact with the tubing.

A hydraulic pump 26 forces the high pressure lubricant into the die socket and in contact with the tubing exterior surface exerting radial compression stress on the tubing entering the draw die as indicated by the arrows shown pressing against the sides of the tubing.

FIG. 1 A is a schematic illistration indicating the lines of stress exerted on the tubing wall. Curved line 13 illustrates what would happen if there is no lubricant pressure being applied to the tubing; the tubing wall would bulge outwardly. Thus, the high pressure lubricant exerting radial compression stress on the tubing wall prevents the tubing wall from bulging outwardly.

Compression feeding mechanism 28 is provided at the entrance to the frame. The compression feeding mechanism includes a pair of opposing rotating rolls 30 and 32 which apply compressive force to the tubing therebetween to advance it into circular bushing 18 and into die socket 20. Rolls 30 and 32 have elastomeric grooved rolls 34 and 36. The rolls are driven by hydraulic motors 38 and 40 in the direction of the arrows. The hydraulic motors are controlled to run at the same speed which pushes the tubing uniformly forward. The speed of the motors can be synchronized by various means such as by a chain mechanism, or a hydraulic flow divider mechanism, or electronically controlled speed valve mechanism.

Figure 1A:
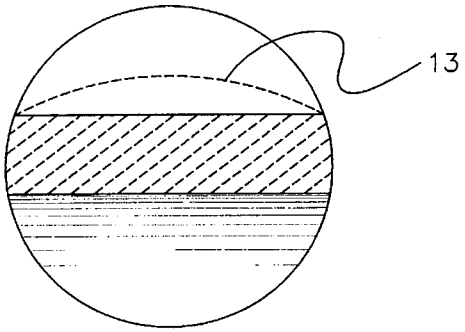
Figure 2:
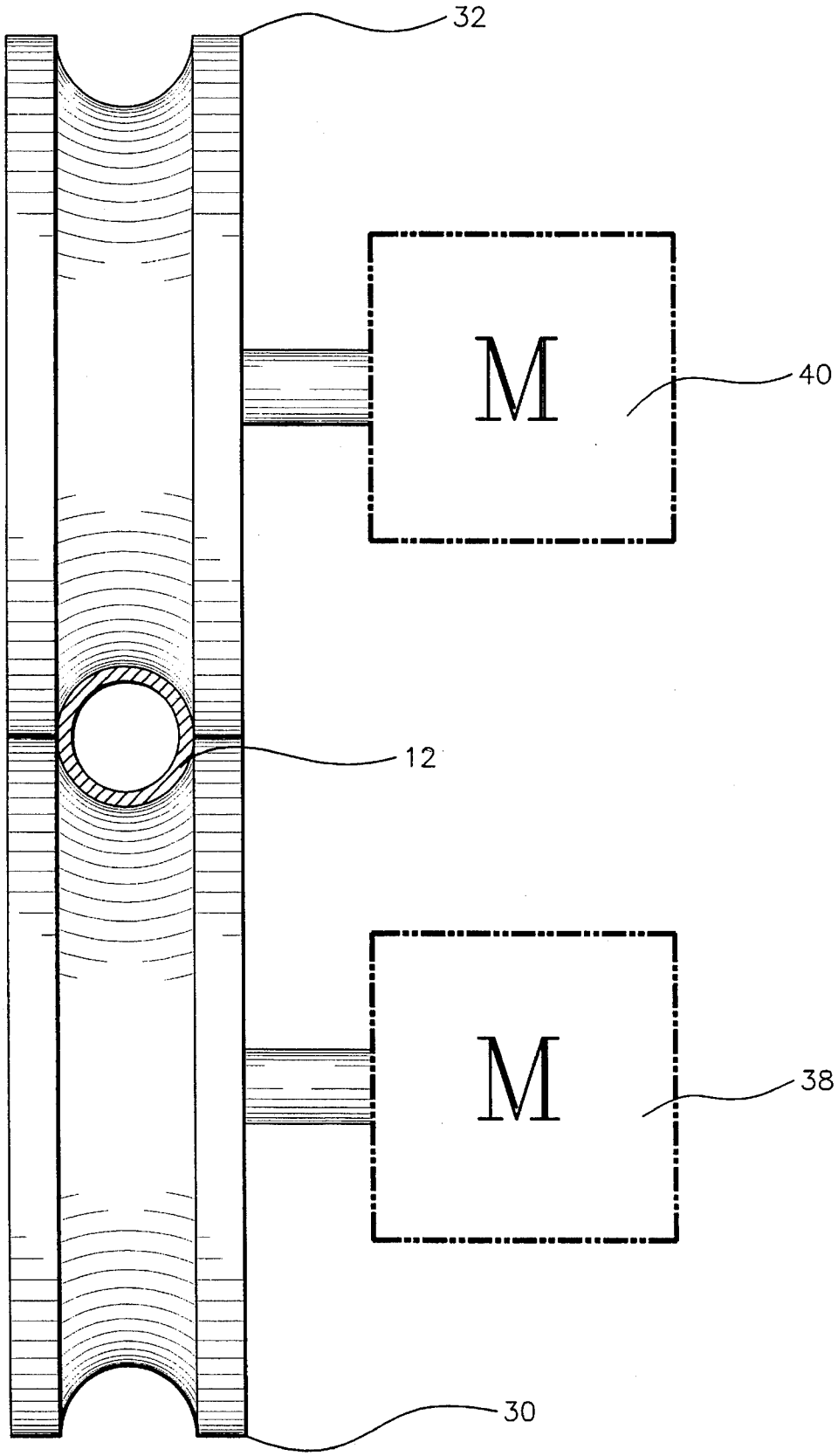
FIG. 2 is a schematic illustration showing the effects of the compression feeding of the invention.

FIGS. 1 and 2 illustrate the forces acting on the tubing during the tube drawing operation of the invention. The tubing is pulled forward, by a draw block not shown, subjecting the tubing to tensile stress. Simultaneous to this forward pulling by the draw block, the compressive movement of tubing 12 between rolls 30 and 32 as indicated in FIG. 2 pushes the tubing forward through circular bushing 18 into die socket 20 and into draw die 14 as seen in FIG. 1. The compressive movement of the tubing from the rolls lessens and partially equalizes the tensile stress from the draw block pulling forward. Coinciding with these two compensating functions is the high pressure lubricant created hydraulic pressure in the die socket 20 which presses on the tubing entering the draw die 14 shown in FIG. 1 and FIG. 1A. The high pressure lubricant generates a compressive stress on the exterior surface of the tubing which lessens the tensile stress and further increases the equalizing of the tensile stress from the draw block pulling forward of the tubing. The high pressure lubricant radial pressure pressing on the tubing prevents the tubing surface from bulging at the entrance to the draw die and also improves the lubrication of the drawing operation by forcing the tubing through the die. Arrows 42 illustrate the applied radial pressure to the exterior surface of the tubing.

Also indicated in FIG. 1 is the zero clearance 44 existing between tubing 12 and circular bushing 18. The zero clearance of the outside diameter of the tubing and the inside diameter circular bushing is critical to the present invention in order to form a seal between the tubing 12 and circular bushing 18 and thus confine the high pressure lubricant within the die socket 20. Hence, with the high pressure lubricant being confined to the die socket, the lubricant in the die socket is able to generate a compressive stress on the tubing by applying radial pressure on its exterior surface.

Zero clearance in the present invention means that the difference between the outside diameter of tubing 10 and the diameter of circular bushing 18 is just enough difference in diameters to allow the tubing to move through the circular bushing in the drawing operation and to create a seal therebetween preventing the high pressure lubricant from passing through. Usually, this difference in the outside diameter of tubes 10 and the inside diameter of circular bushing 18 for zero clearance is about 0.25 percent. Thus, for tubing having an outside diameter of about three eighths of an inch the difference is about 0.001 inch; for tubing having an outside diameter of about two inches the difference is about 0.005 inch.

Figure 3:
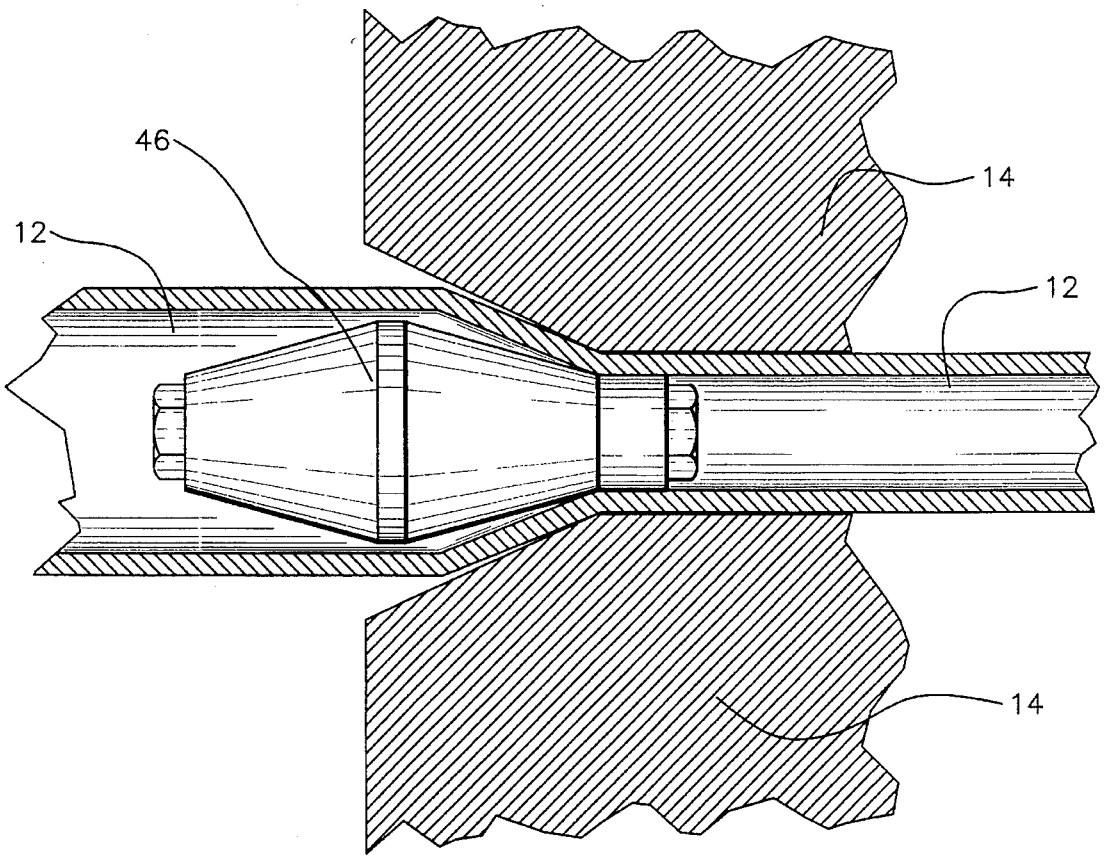
FIG. 3 is a schematic illustration of tubing being reduced in diameter with a floating plug.

FIG. 3 is directed to the tubing being reduced in diameter in the draw die. Shown is tubing 10 in draw die 14 and floating plug 46. Although the present invention is also applicable to spinners, plugs or mandrels which form grooves in the internal surface of the tubing during the drawing procedure, and is further applicable to fixed mandrel for draw bench procedures, FIG. 3 is directed to a floating plug 46 shown having a plain surface and is generally used to produce reduced diameter tubing without inner grooves. Generally, a plain surface floating plug produces a greater reduction in the cross-section of the tubing which can be as much as 30 percent reduction of the original cross section. The present invention, including the novel procedure of zero clearance, high pressure lubricant and feeding rolls is an improvement over the prior art by providing a reduction in cross-section of up to about 60 percent of the original cross-section or twice the reduction as obtained by the prior art. For example, with prior art methods for two inch diameter tubing, generally about eleven passes in tube drawing operations are required to reduce the diameter to three eights of an inch. With the present invention of zero clearance, high pressure lubricant and feed rolls, the same reduction in diameter of the tubing can be accomplished in about six passes through the equipment. Thus, the present invention results in as much as 50 percent fewer passes through the tube drawing stage. The present invention results in savings in time, labor, equipment and inventory over prior art procedure.

Having now fully described the invention, it will be apparent to one of ordinary skill in the art that many changes and modifications can be made thereto without departing from the spirit and scope of the invention as set forth herein.

What is claimed is:

1. An apparatus for advancing and reducing the diameter of tensile stressed tubing being drawn through a draw die wherein the tubing is reduced in diameter comprising in combination, opposing rotatable roll means mounted on the front of the apparatus, the roll means providing a cushioned exterior for compressingly engaging and moving the tubing horizontally under axial compressive stress in the forward direction, a sealing means providing an elongated circular bushing extending horizontally in the forward direction from the roll means towards the draw die for conveying the moving tubing in the forward direction, the inside diameter of said bushing means having zero clearance with the outside diameter of said tubing forming a non-diameter reducing seal therebetween, an enclosed draw die providing a cylindrical socket opening sealed approach zone encircling the conveying tubing prior to entering the draw die, the socket opening approach zone providing means for applying high pressure lubricant created hydraulic pressure to the tubing preventing the tubing from bulging outwardly, the draw die creating tensile stress by pulling therethrough wherein the tubing is reduced in diameter.

2. The apparatus according to claim 1 wherein the roll means provide hydraulic motor means for actuating controlled movement of the roll means.

3. The apparatus according to claim 1 wherein the cushioned exterior surface of the roll means is grooved elastomeric material.

4. The apparatus according to claim 1 wherein a supply port socket opening means provides a supply port means for delivering high pressure lubricant thereto.

5. The apparatus according to claim 4 wherein the supply port means is provided with a lubricant pocket means containing a hydraulic pump means, 6. The apparatus according to claim 1 wherein a diameter reducing plug means is coaxially disposed within the tubing entering the draw die.

7. The apparatus according to claim 6 wherein the diameter reducing plug means has a smooth exterior surface.

8. The apparatus according to claim 6 wherein the diameter reducing plug means has grooved exterior surface.

9. The apparatus according to claim 6 wherein the reducing plug means is a fixed mandrel means for draw bench procedures.

10. A method for reducing the diameter of tubing in a draw die during tube drawing procedures applying tensile stress to the tubing comprising advancing the draw die tensile stressed tubing forward under axial compressive stress towards the draw die, subjecting the advancing tubing under radial compressive stress from high pressure lubricant creating hydraulic pressure preventing the tubing from bulging outwardly at the approach to the draw die, substantially confining the high pressure lubricant created hydraulic pressure to the approach zone of the draw die by advancing forward under zero clearance to confine the high pressure lubricant to the approach zone of the draw die without reducing the diameter of the tubing at the zero clearance, reducing the diameter of the tubing passing through the draw die.

11. A method according to claim 10 wherein the tubing is advanced forward under zero clearance to confine the high pressure lubricant to the approach zone of the draw die.

12. A method according to claim 10 wherein a plug means coaxially engages the tubing inner surface during the tube drawing procedure.

13. A method according to claim 12 wherein the engaging plug means produces a smooth interior surface in the tubing.

14. A method according to claim 12 wherein the engaging plug means produces a grooved interior surface in the tubing.

15. A method according to claim 10 wherein opposed rotating rolls means advance the tubing forward under axial compressive stress.

* * * * *